US010925788B2

(12) United States Patent
Pham

(10) Patent No.: US 10,925,788 B2
(45) Date of Patent: Feb. 23, 2021

(54) INTEGRATED HOSPITAL BED WITH BATH AND WASH FACILITIES

(71) Applicant: Thu Thi Pham, Alexandria, VA (US)

(72) Inventor: Thu Thi Pham, Alexandria, VA (US)

( * ) Notice: Subject to any disclaimer, the term of this patent is extended or adjusted under 35 U.S.C. 154(b) by 296 days.

(21) Appl. No.: 15/984,924

(22) Filed: May 21, 2018

(65) Prior Publication Data

US 2018/0263833 A1 Sep. 20, 2018

(51) Int. Cl.

| | |
|---|---|
| ***A61G 7/02*** | (2006.01) |
| ***A61G 9/00*** | (2006.01) |
| ***A61G 7/002*** | (2006.01) |
| ***A61G 7/00*** | (2006.01) |

(52) U.S. Cl.

CPC ..... *A61G 7/02* (2013.01); *A61G 9/003* (2013.01); *A61G 7/002* (2013.01); *A61G 7/0005* (2013.01)

(58) Field of Classification Search

CPC ..... A61G 7/02; A61G 7/002; A61G 7/0005; A61G 7/015; A61G 9/003; A61G 2203/10; A61G 2203/12

See application file for complete search history.

(56) References Cited

U.S. PATENT DOCUMENTS 5,058,222 A * 10/1991 Workman ..... A61G 5/04 4/453
5,269,030 A * 12/1993 Pahno ..... A61G 7/0005 4/480
8,898,838 B1 * 12/2014 Tu ..... A61G 7/015 5/604
9,084,703 B1 * 7/2015 Fair ..... A61G 9/003
9,364,124 B2 * 6/2016 Morris ..... A47K 11/026
2006/0026765 A1 * 2/2006 Hornbach ..... A61G 7/015 5/618
2011/0179571 A1 * 7/2011 Clayton ..... A61G 7/02 5/605
2012/0144575 A1 * 6/2012 Sanchez Moreno ... A61G 9/003 4/452
2013/0046150 A1 * 2/2013 Devanaboyina ..... A61B 5/0476 600/301
2014/0068862 A1 * 3/2014 Al-Jafar ..... A61G 9/003 5/605
2016/0113809 A1 * 4/2016 Kim ..... A61F 5/4408 604/353
2017/0055881 A1 * 3/2017 Kang ..... A61B 5/1072
2017/0065134 A1 * 3/2017 Tanguay ..... A47K 11/02
2017/0112716 A1 * 4/2017 Rawls-Meehan ..... A61G 7/015
2018/0289569 A1 * 10/2018 Hara ..... A61G 7/02
2019/0365263 A1 * 12/2019 Raj ..... A61B 5/0024

* cited by examiner

*Primary Examiner* — David R Hare
*Assistant Examiner* — Alexis Felix Lopez
(74) *Attorney, Agent, or Firm* — Barry Choobin; Patent 360

(57) ABSTRACT

The embodiments herein discloses a patient friendly bed provided with a toilet facility that enables the patient to use the toilet without assistance and without leaving the bed. A mattress provided in the bed comprises a trap door which separates to allow the patient to perform bodily functions. The bed comprises a cleaning and waste packaging mechanism for packaging solid and liquid waste in a sealed container and for storing the packaged waste for later removal. The bed is operable using a remote control unit. A sensor device is worn around the patient waist and stomach area to sense a need of the patient to perform bodily functions and automatically operate the bed functions.

14 Claims, 3 Drawing Sheets

INTEGRATED HOSPITAL BED WITH BATH AND WASH FACILITIES

BACKGROUND

Technical Field

The embodiments herein are generally related to the field of hospital beds adapted for nursing. The embodiments herein are particularly related to hospital beds for use in the care and treatment of invalidated individuals confined to bed. The embodiments herein are more particularly related to a patient friendly hospital bed with integrated wash and toilet facility to enables the incapacitated and invalidated patients to perform bodily functions without leaving the bed.

Description of the Related Art

A prime concern for hospital/nursing home staff or a caretaker/caregiver faced during the nursing of immobile and/or bedridden patients is in helping the patients in performing their day to day bodily functions at ease. In most of the cases, bedpans are used for this purpose. The use of bedpans requires movement of the patient which results in providing a discomfort to the patient and similar inconvenience to the caretaker.

Additionally, the patient has to completely depend on the caretaker to attend to their individual personal needs. Moreover, the patient such as patients with heavy weight, sometimes get injured during the process, especially when the patients are of heavy weight. This causes both physical as well as psychological trauma to the patients. This also creates immense pressure on the caretaker or nursing personnel in charge of the patient during a long durations of stay with the patient.

Moreover, the existing hospital beds mostly do not provide either the ability to perform the bodily functions or clean the patient afterward. In some hospitals, the beds are provided with a sectional opening for performing the bodily functions but a facility for subsequent removal and packaging of waste products is not provided.

Hence, there is a need for a patient friendly hospital bed with integrated toilet facility to enable the patients to perform bodily functions without leaving the bed. There is also a need for a patient friendly hospital bed to enable the patients to perform their bodily functions without any assistance from the caretakers/nursing professionals. Further, there is a need for a patient friendly hospital bed to offer a patient cleaning and waste disposal mechanism along with the facility for performing bodily functions.

The above mentioned shortcomings, disadvantages and problems are addressed herein and which will be understood by reading and studying the following specification.

OBJECTS OF THE EMBODIMENTS HEREIN

The primary object of the embodiments herein is to provide a patient friendly hospital bed with integrated toilet and wash facility to enables the patients to perform bodily functions without leaving the bed.

Another object of the embodiments herein is to provide a patient friendly hospital bed to facilitate the patients to perform bodily functions without taking any assistance from caretakers/nursing professionals.

Yet another object of the embodiments herein is to provide a patient friendly hospital bed provided with a patient cleaning and waste disposal mechanism along with the facility for performing bodily functions.

Yet another object of the embodiments herein is to provide a patient friendly hospital bed with an integrated toilet and wash facility to enable the patients to use the toilet without any assistance and without leaving the bed.

Yet another object of the embodiments herein is to provide a hospital bed comprising of a mattress provided with a plurality of layers that are separated to allow the patient to perform bodily functions, as well as other attachments for cleaning and waste capture/packaging components.

Yet another object of the embodiments herein is to provide a hospital bed that is automatically moved to a desired position to enable the patient to perform a particular bodily function.

Yet another object of the embodiments herein is to provide a patient friendly hospital bed provided with an automated bidet that cleans the patient on completion of bodily functions.

Yet another object of the embodiments herein is to provide a patient friendly hospital bed provided with a trap door which is arranged in the mattress and opened up for performing bodily functions and exposing the waste collection tank/chamber.

Yet another object of the embodiment herein is to provide a hospital bed with a packaging mechanism for packing solid and liquid wastes in a sealed container and storing the packaged waste for later removal.

Yet another object of the embodiment herein is to provide a patient friendly hospital bed configured to use available/existing room plumbing or attached water tank and waste disposal mechanism.

Yet another object of the embodiment herein is to provide a patient friendly hospital bed with automatically adjustable size fitting mechanism for opening the mattress and providing the patient with a clear and direct access to the waste collection tank.

Yet another object of the embodiment herein is to provide a hospital bed provided with a box of bags attached to the bottom of the bed frame which automatically opens and zip closes for each use by the patient to collect solid and liquid waste resulting from bodily functions and from the automated bidet cleaning process.

Yet another object of the embodiment herein is to provide a patient friendly hospital bed that is operated with a remote control unit or voice command.

Yet another object of the embodiment herein is to provide a patient friendly hospital bed that allows handicapped patients to control the bed function using their speech or voice commands.

Yet another object of the embodiment herein is to provide a hospital bed with one or more sensors or wearing around the patient waist and stomach area to sense patient's need to perform bodily functions and automatically operate the bed functions.

Yet another object of the embodiments herein is to provide a patient friendly bed that sends timely notifications to the caretakers, when the waste collection tank reaches its full capacity.

Yet another object of the embodiments herein is to provide a hospital bed that helps the patients to close the opening of mattress and return the bed to its original position on completion of the cleaning process using the remote controller or the voice commands.

Yet another object of the embodiments herein is to provide a hospital bed that helps the bed-ridden patients in maintaining sanity while performing their day to day bodily functions.

Yet another object of the embodiments herein is to provide a hospital bed that helps in preventing accidents to the bed-ridden patients while performing their bodily functions.

These and other objects and advantages of the embodiments herein will become readily apparent from the following detailed description taken in conjunction with the accompanying drawings.

SUMMARY

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

The following details present a simplified summary of the embodiments herein to provide a basic understanding of the several aspects of the embodiments herein. This summary is not an extensive overview of the embodiments herein. It is not intended to identify key/critical elements of the embodiments herein or to delineate the scope of the embodiments herein. Its sole purpose is to present the concepts of the embodiments herein in a simplified form as a prelude to the more detailed description that is presented later.

The various embodiments herein provide a patient friendly hospital bed with integrated toilet/wash and waste collection mechanism. The hospital bed comprises a bed frame. The bed frame comprises a head and torso support section, a back/buttock support section and a leg support section. A mattress is placed/spread over the bed frame. A patient is made to rest on top of the mattress while using the bed. The mattress comprises a head and torso mattress section, a buttock mattress section and a leg mattress section. The buttock mattress section further comprises a pivoting mattress section at the centre. The bed further comprises a trap door mechanism attached below the pivoting mattress section. The trap door mechanism is configured for opening and closing the pivoting mattress section and a trap door based on patient's need to perform bodily functions. The opening and closing of the pivoting mattress section and the trap door is activated by the patient using a remote control unit, or one or more voice commands or a push button mechanism. The bed further comprises a waste collection and disposal mechanism provided under the pivoting mattress section. The waste collection and disposal mechanism is configured for collecting and disposing the solid and liquid wastes resulting from the patient's bodily function. The bed still further comprises a cleaning mechanism attached with a trap door mechanism. The cleaning mechanism is configured for cleaning the patient upon completion of the bodily functions.

According to an embodiment herein, the bed further comprises one or more actuators. The one or more actuators are actuated for placing the bed into one or more positions to enable the patient to perform a particular bodily function. The one or more positions comprise elevating the head and torso support section to one or more predefined heights and lowering the leg support section by one or more predefined angles.

According to an embodiment herein, the cleaning mechanism further comprises an automatic bidet and an air pressure unit. The automatic bidet is configured for cleaning the patient on completion of bodily functions using a water spray. The air pressure unit is configured for blowing air for completing the cleaning process after a water spray cleaning of the patient.

According to an embodiment herein, the waste collection and disposal mechanism further comprises a toilet bowl attached just below the trap door for collecting the waste resulting from the bodily functions of the patient.

According to an embodiment herein, the waste collection and disposal mechanism further comprises one or more attachments for connecting the bed with one or more plumbing and waste disposal lines available in the hospital/house premises. The solid and liquid waste resulting from patient's bodily functions and from the cleaning cycle of the automated bidet are flushed away using the plumbing and waste disposal lines.

According to an embodiment herein, the bed further comprises an optional waste collection tank. The waste collection tank is configured for collecting the solid and liquid waste resulting from the patients bodily functions in case of non-attachment to the one or more plumbing and waste disposal lines.

According to an embodiment herein, the waste disposal mechanism further comprises a box of bags attached with the waste collection tank. The box of bags is configured for automatically opening and closing of the trap door by the patient after each use case. One or more bags from the box of bags are used for collecting and packaging solid and liquid waste from resulting from the bodily functions of the patient.

According to an embodiment herein, the bed is further configured for performing a plurality of tasks when activated using the remote control unit, by issuing one or more voice commands or by using the push button mechanism. The plurality of tasks comprise placing the bed in a position suitable to the patient for performing bodily functions, opening and closing the trap door, activating the automatic bidet and the air pressure unit on completion of the bodily functions and changing the bed to sleeping position on completion of the bodily function.

According to an embodiment herein, the bed further comprises one or more sensors. The one or more sensors are worn around waist and stomach area of the patient. The one or more sensors are configured for detecting a need of the patient for performing bodily functions, sensing waste collection tank status and sensing one or more voice commands given by the patient for operating the trap door.

According to an embodiment herein, the bed further comprises a notification unit. The notification unit is configured for generating and sending one or more notifications to the caretaker indicating a filling status of the waste collection tank. The filling status comprises not filled, needs a change and needs immediate attention.

According to an embodiment herein, the bed further comprises a display unit attached with the bed. The display unit is configured for displaying/exhibiting/indicating the one or more notification related to waste collection tank status for the caretaker and for displaying the voice commands issued by the patient while using the bed.

According to an embodiment herein, a method for using a patient friendly bed with integrated toilet, wash and waste collection mechanism is provided. The method comprises changing a position of the bed from a sleeping position to a desired position that enables the patient to perform a particular bodily function easily. The bed position is changed by activating one or more actuators provided in the bed. The method also comprises providing commands and signals to open the trap door mechanism to further open the pivoting mattress section to enable the patient to perform bodily functions. The method further comprises activating the cleaning mechanism attached with the trap door mechanism. The activation of cleaning mechanism in-turn activates an automatic bidet and an air pressure unit for cleaning and subsequently drying the patient upon completion of the bodily functions. The method still further comprises signaling the trap door to close on completion of the bodily functions by the patient and changing the position of the bed back to normal sleeping position.

According to an embodiment herein, the method further comprises the steps of activating the bed functionalities using a remote control unit, by issuing one or more voice commands or by using a push button mechanism provided in the bed.

According to an embodiment herein, the method further comprises the steps of flushing away the solid and liquid waste resulting from patient's bodily functions using one or more plumbing and waste disposal lines available in the hospital/house premises. One or more attachments are used for connecting the bed with the one or more plumbing and waste disposal lines.

According to an embodiment herein, the method further comprises the steps of collecting the solid and liquid waste resulting from the patient's bodily functions using a waste collection tank in case of non-attachment to the one or more plumbing and waste disposal lines.

According to an embodiment herein, the method further comprises the steps of using one or more bags from a box of bags for collecting and packaging solid and liquid waste from resulting from the bodily functions of the patient. The box of bags is attached with the waste collection tank.

According to an embodiment herein, the method further comprises the steps of providing one or more sensors for detecting a need of the patient for performing bodily functions, sensing waste collection tank status and sensing one or more voice commands given by the patient for operating the trap door.

According to an embodiment herein, the method further comprises the steps of generating and sending one or more notifications to the caretaker indicating a filling status of the waste collection tank. The filling status comprises not filled, needs a change and needs immediate attention.

According to an embodiment herein, the method further comprises the steps of displaying the one or more notifications related to waste collection tank status for the caretaker and displaying the voice commands issued by the patient while using the bed using a display unit.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

BRIEF DESCRIPTION OF THE DRAWINGS

The other objects, features and advantages will occur to those skilled in the art from the following description of the preferred embodiment and the accompanying drawings in which.

Figure 1:
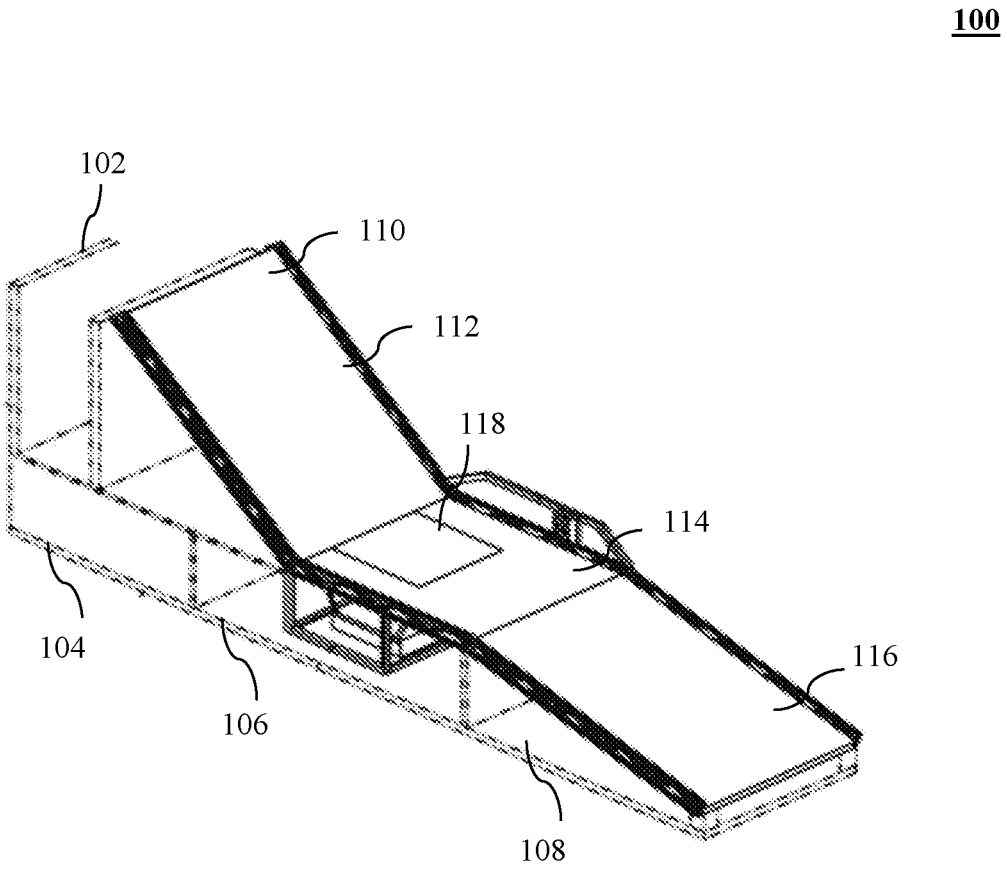
FIG. 1 illustrates a front view of the bed with integrated toilet facility, according to an embodiment herein.

Although the specific features of the present invention are shown in some drawings and not in others. This is done for convenience only as each feature may be combined with any or all of the other features in accordance with the embodiments herein.

DETAILED DESCRIPTION OF THE EMBODIMENTS

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

The various embodiments herein provide a patient friendly hospital bed with integrated toilet/wash and waste collection mechanism. The hospital bed comprises a bed frame. The bed frame comprises a head and torso support section, a back/buttock support section and a leg support section. A mattress is placed/spread over the bed frame. A patient is made to rest on top of the mattress while using the bed. The mattress comprises a head and torso mattress section, a buttock mattress section and a leg mattress section. The buttock mattress section further comprises a pivoting mattress section at the centre. The bed further comprises a trap door mechanism attached below the pivoting mattress section. The trap door mechanism is configured for opening and closing the pivoting mattress section and a trap door based on patient's need to perform bodily functions. The opening and closing of the pivoting mattress section and the trap door is activated by the patient using a remote control unit, or one or more voice commands or a push button mechanism. The bed further comprises a waste collection and disposal mechanism provided under the pivoting mattress section. The waste collection and disposal mechanism is configured for collecting and disposing the solid and liquid wastes resulting from the patient's bodily function. The bed still further comprises a cleaning mechanism attached with a trap door mechanism. The cleaning mechanism is configured for cleaning the patient upon completion of the bodily functions.

According to an embodiment herein, the bed further comprises one or more actuators. The one or more actuators are actuated for placing the bed into one or more positions to enable the patient to perform a particular bodily function. The one or more positions comprise elevating the head and torso support section to one or more predefined heights and lowering the leg support section by one or more predefined angles.

According to an embodiment herein, the cleaning mechanism further comprises an automatic bidet and an air pressure unit. The automatic bidet is configured for cleaning the patient on completion of bodily functions using a water spray. The air pressure unit is configured for blowing air for completing the cleaning process after a water spray cleaning of the patient.

According to an embodiment herein, the waste collection and disposal mechanism further comprises a toilet bowl attached just below the trap door for collecting the waste resulting from the bodily functions of the patient.

According to an embodiment herein, the waste collection and disposal mechanism further comprises one or more attachments for connecting the bed with one or more plumbing and waste disposal lines available in the hospital/house premises. The solid and liquid waste resulting from patient's bodily functions and from the cleaning cycle of the automated bidet are flushed away using the plumbing and waste disposal lines.

According to an embodiment herein, the bed further comprises an optional waste collection tank. The waste collection tank is configured for collecting the solid and liquid waste resulting from the patients bodily functions in case of non-attachment to the one or more plumbing and waste disposal lines.

According to an embodiment herein, the waste disposal mechanism further comprises a box of bags attached with the waste collection tank. The box of bags is configured for automatically opening and closing of the trap door by the patient after each use case. One or more bags from the box of bags are used for collecting and packaging solid and liquid waste from resulting from the bodily functions of the patient.

According to an embodiment herein, the bed is further configured for performing a plurality of tasks when activated using the remote control unit, by issuing one or more voice commands or by using the push button mechanism. The plurality of tasks comprise placing the bed in a position suitable to the patient for performing bodily functions, opening and closing the trap door, activating the automatic bidet and the air pressure unit on completion of the bodily functions and changing the bed to sleeping position on completion of the bodily function.

According to an embodiment herein, the bed further comprises one or more sensors. The one or more sensors are worn around waist and stomach area of the patient. The one or more sensors are configured for detecting a need of the patient for performing bodily functions, sensing waste collection tank status and sensing one or more voice commands given by the patient for operating the trap door.

According to an embodiment herein, the bed further comprises a notification unit. The notification unit is configured for generating and sending one or more notifications to the caretaker indicating a filling status of the waste collection tank. The filling status comprises not filled, needs a change and needs immediate attention.

According to an embodiment herein, the bed further comprises a display unit attached with the bed. The display unit is configured for displaying/exhibiting/indicating the one or more notification related to waste collection tank status for the caretaker and for displaying the voice commands issued by the patient while using the bed.

According to an embodiment herein, a method for using a patient friendly bed with integrated toilet, wash and waste collection mechanism is provided. The method comprises changing a position of the bed from a sleeping position to a desired position that enables the patient to perform a particular bodily function easily. The bed position is changed by activating one or more actuators provided in the bed. The method also comprises providing commands and signals to open the trap door mechanism to further open the pivoting mattress section to enable the patient to perform bodily functions. The method further comprises activating the cleaning mechanism attached with the trap door mechanism. The activation of cleaning mechanism in-turn activates an automatic bidet and an air pressure unit for cleaning and subsequently drying the patient upon completion of the bodily functions. The method still further comprises signaling the trap door to close on completion of the bodily functions by the patient and changing the position of the bed back to normal sleeping position.

According to an embodiment herein, the method further comprises the steps of activating the bed functionalities using a remote control unit, by issuing one or more voice commands or by using a push button mechanism provided in the bed.

According to an embodiment herein, the method further comprises the steps of flushing away the solid and liquid waste resulting from patient's bodily functions using one or more plumbing and waste disposal lines available in the hospital/house premises. One or more attachments are used for connecting the bed with the one or more plumbing and waste disposal lines.

According to an embodiment herein, the method further comprises the steps of collecting the solid and liquid waste resulting from the patient's bodily functions using a waste collection tank in case of non-attachment to the one or more plumbing and waste disposal lines.

According to an embodiment herein, the method further comprises the steps of using one or more bags from a box of bags for collecting and packaging solid and liquid waste from resulting from the bodily functions of the patient. The box of bags is attached with the waste collection tank.

According to an embodiment herein, the method further comprises the steps of providing one or more sensors for detecting a need of the patient for performing bodily functions, sensing waste collection tank status and sensing one or more voice commands given by the patient for operating the trap door.

According to an embodiment herein, the method further comprises the steps of generating and sending one or more notifications to the caretaker indicating a filling status of the waste collection tank. The filling status comprises not filled, needs a change and needs immediate attention.

According to an embodiment herein, the method further comprises the steps of displaying the one or more notifications related to waste collection tank status for the caretaker and displaying the voice commands issued by the patient while using the bed using a display unit.

FIG. 1 illustrates a front view of the bed with integrated toilet facility, according to an embodiment herein. With respect to FIG. 1, the bed comprises the bed frame 102. The bed frame comprises the head and torso support section 104, the buttock support section 106 and the leg support section 108. The bed also comprises the mattress 110 placed atop the bed frame 102. A patient is rested on top of the mattress 110 while using the bed. The mattress 110 comprises the head and torso mattress section 112, the buttock mattress section 114 and the leg mattress section 116. The buttock mattress section 114 further comprises the pivoting mattress section 118 at the centre.

Figure 2:
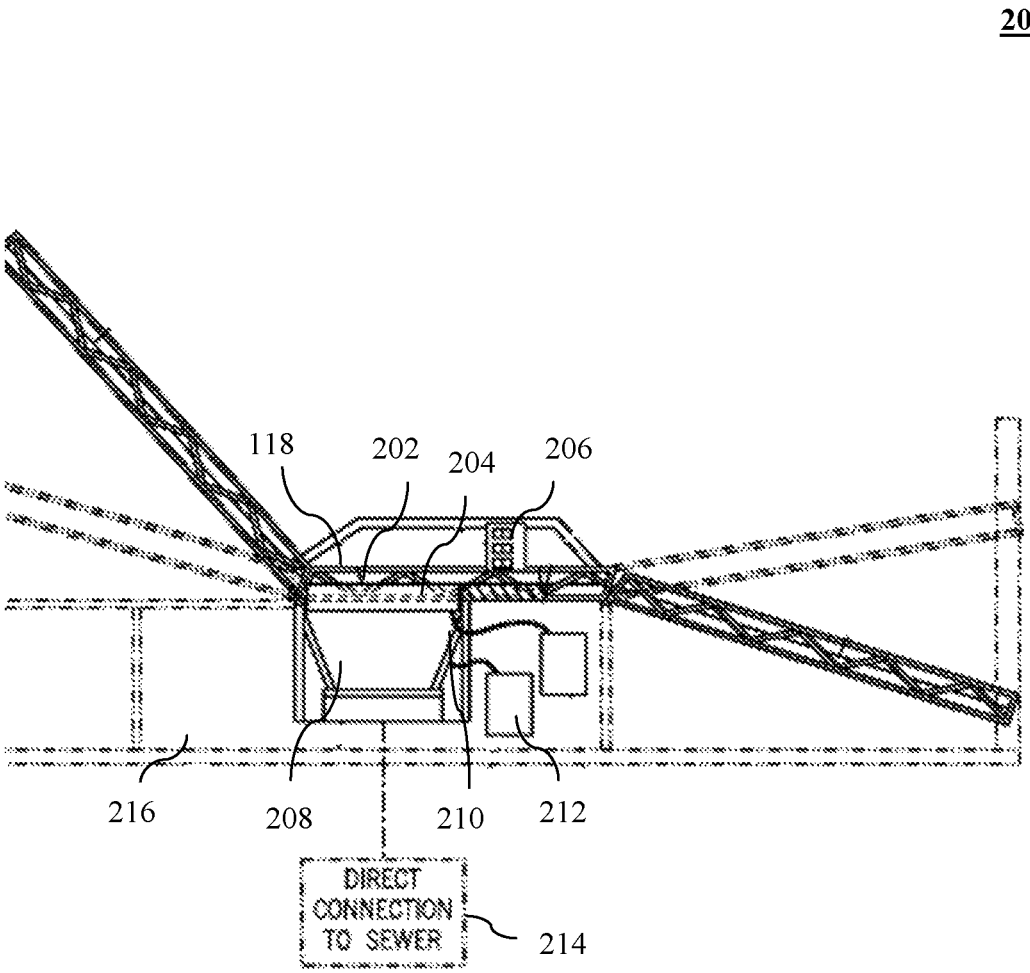
FIG. 2 illustrates a side view of the bed with integrated toilet facility, according to an embodiment herein.

FIG. 2 illustrates a side view of the bed with integrated toilet facility, according to an embodiment herein. With respect to FIG. 2, the various parts of the bed are shown. The bed further comprises the trap door mechanism 202 attached below the pivoting mattress section 118. The trap door mechanism 202 is configured for opening and closing the pivoting mattress section 118 and the trap door 204 based on patient's need to perform bodily function. The opening and closing of the pivoting mattress section 118 and the trap door 204 is activated by the patient using a remote control unit 206, one or more voice commands or using a push button mechanism. A voice activation device (not shown) is provided with the bed in case the patient is handicapped. The voice activation device allows the handicapped patient to control the bed functions using their speech. The voice activation device can be trained to understand the limited number of commands to which the bed is configured for responding. And if the patient cannot speak, the caretaker can operate the controls at the direction of the patient. In this case, the services of the caretaker are indeed required, but there is no need for the patient to leave the bed and take the risk of injury to both the patient and the caretaker.

According to an embodiment herein, the bed further comprises the waste collection and disposal mechanism 208 is provided under the pivoting mattress section 118. The waste collection and disposal mechanism 208 is configured for collecting and disposing the solid and liquid waste collected from the patient. The bed still further comprises the cleaning mechanism 210 attached with the trap door mechanism 202. The cleaning mechanism 210 is configured for cleaning the patient upon completion of the bodily functions. The cleaning mechanism 210 further comprises an automatic bidet (not shown) and an air pressure unit 212. The automatic bidet is configured for cleaning the patient on completion of bodily functions using a water spray. The air pressure unit 212 is configured for blowing air for completing the cleaning process after water spray cleaning of the patient. The waste collection and disposal mechanism 208 further comprises a toilet bowl (not shown) attached just below the trap door 204 for collecting the waste resulting from the bodily functions of the patient. The waste collection and disposal mechanism 208 further comprises one or more attachments (not shown) for connecting the bed with one or more plumbing and waste disposal lines 214 available in the hospital/house premises. The solid and liquid waste resulting from patient's bodily functions and from the cleaning cycle of the automated bidet are flushed away using the plumbing and waste disposal lines.

According to an embodiment herein, the bed further comprises one or more actuators (not shown). The one or more actuators when actuated are configured for placing the bed into one or more positions that enable the patient to perform a particular bodily function. The one or more positions comprise elevating the head and torso support section 104 to one or more predefined heights and lowering the leg support section 108 by one or more predefined angles.

According to an embodiment herein, the bed further comprises the optional waste collection tank 216 as part of the waste collection and disposal mechanism 208. The waste collection tank 216 is configured for collecting the solid and liquid waste from the patient on completion of the bodily function in case direct attachment to the one or more plumbing and waste disposal lines 214 is not available. The waste collection and disposal mechanism 208 further comprises a box of bags (not shown) attached with the waste collection tank 216. The box of bags is configured for automatically opening and closing for each use of the trap door 204 by the patient. The one or more bags from the box of bags are used for collecting and packaging solid and liquid waste from resulting from the bodily functions of the patient. The waste products are packaged in sealed bags that are stored under the bed until removed by the caretaker.

According to an embodiment herein, the bed is further configured for performing a plurality of tasks when activated using the remote control unit 206, by issuing one or more voice commands or by using the push button mechanism. The plurality of tasks comprise placing the bed in a position suitable to the patient for performing bodily functions, opening and closing the trap door 204, activating the automatic bidet and the air pressure unit on completion of the bodily functions and changing the bed to sleeping position on completion of the bodily function.

According to an embodiment herein, the bed further comprises one or more sensors (not shown). The one or more sensors are worn around waist and stomach area of the patient. The one or more sensors are configured for sensing patient's need for performing bodily functions, sensing waste collection tank status and sensing one or more voice commands given by the patient for operating the trap door 204. The bed further comprises a notification unit (not shown). The notification unit is configured for generating and sending one or more notifications to the caretaker indicating fill status of the waste collection tank 216. The fill status comprises not filled, needs a change and needs immediate attention. The bed further comprises a display unit (not shown) attached with the bed. The display unit is configured for displaying the one or more notification related to waste collection tank status for the caretaker and for displaying the voice commands issued by the patient while using the bed.

Figure 3:
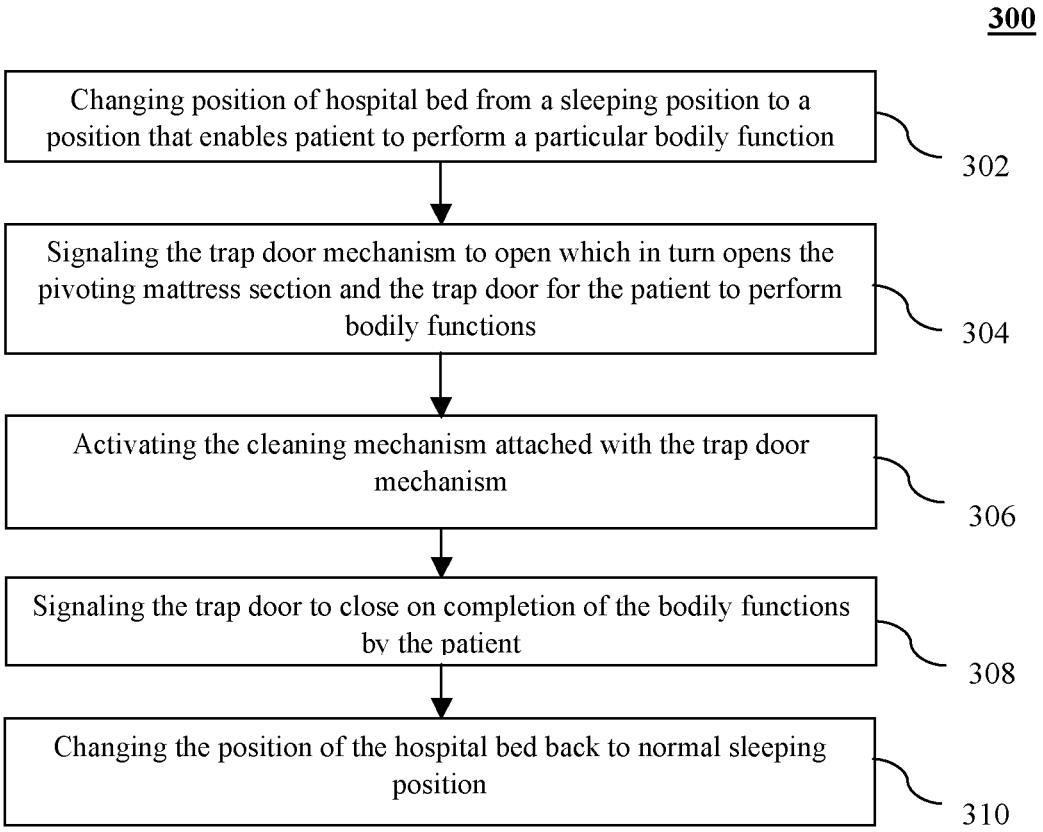
FIG. 3 illustrates a flowchart explaining a method of using the bed with integrated toilet facility, according to an embodiment herein.

FIG. 3 illustrates a flowchart explaining a method of using the bed with integrated toilet facility, according to an embodiment herein. The method comprises the steps of changing position of the bed from a sleeping position to a position that enables the patient to perform a particular bodily function (302). The bed position is changed by activating one or more actuators provided in the bed. The method also comprises signaling the trap door mechanism to open which in turn opens the pivoting mattress section and the trap door for the patient to perform bodily functions (304) and activating the cleaning mechanism attached with the trap door mechanism (306). The activation of cleaning mechanism in-turn activates an automatic bidet and a air pressure unit for cleaning and subsequently drying the patient upon completion of the bodily functions. The method still further comprises signaling the trap door to close on completion of the bodily functions by the patient (308) and changing the position of the bed back to normal sleeping position (310).

According to an embodiment herein, the method also comprises activating the bed functionalities using a remote control unit, by issuing one or more voice commands or by using a push button mechanism provided in the bed. The method further comprises the steps of flushing away the solid and liquid waste resulting from patient's bodily functions using one or more plumbing and waste disposal lines available in the hospital/house premises, and wherein one or more attachments are used for connecting the bed with the one or more plumbing and waste disposal lines. The solid and liquid waste resulting from the patient's bodily functions is collected using a waste collection tank in case direct attachment to the one or more plumbing and waste disposal lines is not available. One or more bags from a box of bags are used for collecting and packaging solid and liquid waste from resulting from the bodily functions of the patient, and wherein the box of bags is attached with the waste collection tank.

Further, one or more sensors are provided for sensing patient's need for performing bodily functions, sensing waste collection tank status and sensing one or more voice commands given by the patient for operating the trap door. One or more notifications are generated and sent to the caretaker indicating fill status of the waste collection tank. The fill status comprises not filled, needs a change and needs immediate attention. The one or more notification related to waste collection tank status for the caretaker and the voice commands issued by the patient while using the bed are displayed using a display unit.

Therefore, the bed is integrated with a toilet that enables the patients to perform bodily functions without leaving the bed and without any assistance. Thus, the bed removes the dependence of an incapacitated patient on the availability of a caretaker. The bed also offers a patient cleaning and waste disposal mechanism along with the facility for performing bodily functions. The bed is very patient friendly as it automatically attains a position that enables the patient to perform a particular bodily function. The automated bidet provided in the bed cleans the patient on completion of bodily function. The bed uses available plumbing or attached water tank for this purpose. The automatic adjustable size fitting mechanical modification present in the bed opens the mattress and allows the patient clear access to the waste collection tank. A box of bags is attached to the bottom of the bed frame which automatically opens and zip closes for each use to collects solid and liquid waste both from the patient and from the automated bidet cleaning process.

Further, the bed is easy to operate using a remote control unit and hence is very convenient for patients. A sensor device for wearing around the patient waist and stomach area is also provided along with the bed for sensing patient's need to perform bodily functions and automatically for operating the bed functions. The bed further offers the facility of sending timely notifications to the caretakers when the waste disposal tank reaches its full capacity.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments.

It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

It is also to be understood that the following claims are intended to cover all of the generic and specific features of the embodiments described herein and all the statements of the scope of the embodiments which as a matter of language might be the to fall there between.

What is claimed is:

1. A patient friendly bed with an integrated toilet facility, the bed comprising:

a bed frame, and wherein the bed frame comprises a head and torso support section, a buttock support section, and a leg support section;

a mattress placed above the bed frame, and wherein the mattress is configured to receive a patient on top of the mattress, the mattress comprises a head and torso mattress section, a buttock mattress section, and a leg mattress section, wherein the buttock mattress section comprises a pivoting mattress section at the center;

a trap door mechanism attached below the pivoting mattress section, wherein the trap door mechanism is configured to open and close the pivoting mattress section and a trap door, based on a need of the patient to perform bodily functions;

a waste collection and disposal mechanism provided under the pivoting mattress section, the waste collection and disposal mechanism is configured for collecting and disposing of solid and liquid waste resulting from the bodily functions, the waste collection and disposal mechanism further comprises a waste collection tank, the waste collection tank is configured for collecting the solid and liquid waste;

a cleaning mechanism attached to the trap door mechanism, wherein the cleaning mechanism is configured for cleaning the patient upon completion of the bodily functions;

one or more actuators configured for placing the bed into one or more positions to enable the patient to perform the bodily functions upon actuation;

one or more sensors, the one or more sensors configured to be worn around waist and stomach of the patient for detecting a need of the patient for performing the bodily functions, the one or more sensors further configured to cause the bed to switch to the one or more positions for allowing the patient to perform the bodily functions;

one or more second sensors configured for detecting a status of the waste collection tank;

wherein the bed is further configured for performing a plurality of tasks upon activation through the remote-control unit, by issuing one or more voice commands; and a display unit attached to the bed, wherein the display unit is configured for displaying one or more notifications related to the status of the waste collection tank and for displaying the one or more voice commands issued by the patient while using the bed.

2. The bed according to claim 1, wherein the one or more positions comprise elevating the head and torso support section to one or more predefined heights and lowering the leg support section by one or more predefined angles.

3. The bed according to claim 1, wherein the cleaning mechanism further comprises an automatic bidet and an air pressure unit, the automatic bidet is configured for cleaning the patient on completion of the bodily functions using a stream of water, the air pressure unit is configured for blowing air to dry areas of the patient wetted by the stream of water.

4. The bed according to claim 1, wherein the waste collection and disposal mechanism further comprises a toilet bowl attached below the trap door for collecting the waste resulting from the bodily functions.

5. The bed according to claim 1, wherein the waste collection and disposal mechanism further comprises one or more attachments for connecting the bed with one or more plumbing and waste disposal lines available in the hospital/house premises, and wherein the solid and liquid waste resulting from patient's bodily functions and from the cleaning cycle of the automated bidet are flushed away using the plumbing and waste disposal lines.

6. The bed according to claim 1, wherein the waste collection and disposal mechanism further comprises:

a box of bags attached to the waste collection tank, the box of bags comprises a plurality of bags, the box of bags configured to:

cause a bag from the plurality of bags to open with the opening of the trap door for collecting the solid and liquid waste, and close the bag with the closing of the trap door.

7. The bed according to claim 1, wherein the plurality of tasks comprises placing the bed in a position suitable to the patient for performing bodily functions, opening and closing the trap door, activating the automatic bidet and the air pressure unit on completion of the bodily functions and changing the bed to sleeping position on completion of the bodily function.

8. The bed according to claim 1, wherein the one or more second sensors configured for notifying the status of the waste collection tank to a caretaker.

9. A method for using a patient friendly bed with integrated toilet facility, wherein the method comprises:

detecting, by one or more sensors, worn around waist and stomach of a patient, a need of the patient for performing the bodily functions;

upon detecting the need, changing a position of the bed from a sleeping position to a position that enables the patient to perform the bodily functions, wherein the bed position is changed automatically by activating one or more actuators provided in the bed;

issuing commands from a remote-control unit to operate a trap door mechanism for opening a pivoting mattress section and a trap door for the patient to perform the bodily functions;

activating a cleaning mechanism attached to the trap door mechanism, wherein the activation of cleaning mechanism in-turn activates an automatic bidet and an air pressure unit for cleaning and subsequently drying the patient upon completion of the bodily functions;

issuing commands from the remote-control unit to close the trap door upon completion of the bodily functions;

changing the position of the bed to the sleeping position;

providing one or more second sensors for detecting a status of a waste collection tank;

activating the bed functionalities using the remote-control unit, by issuing one or more voice commands; and displaying the status of the waste collection tank and the voice commands issued by the patient on a display unit.

10. The method according to claim 9, wherein the method further comprises the steps of activating the bed functionalities using a push button mechanism provided with the bed.

11. The method according to claim 9, wherein the method further comprises the steps of flushing away the solid and liquid waste resulting from patient's bodily functions using one or more plumbing and waste disposal lines available in the hospital/house premises, and wherein one or more attachments are used for connecting the bed with the one or more plumbing and waste disposal lines.

12. The method according to claim 9, wherein the method further comprises the steps of collecting solid and liquid waste resulting from the bodily functions in the waste collection tank.

13. The method according to claim 12, wherein the method further comprises the steps of using one or more bags from a box of bags for collecting solid and liquid waste resulting from the bodily functions, wherein the box of bags is attached with the waste collection tank.

14. The method according to claim 9, wherein the method further comprises a step of sending the status to a caretaker.

* * * * *